US005778802A

United States Patent [19]

Hairston et al.

[11] Patent Number: 5,778,802

[45] Date of Patent: Jul. 14, 1998

[54] TABLE COVER SYSTEM

[76] Inventors: Jana L. Hairston; Ryland Hairston, both of 679 A Infantry Post Rd., San Antonio, Tex. 78234-5000

[21] Appl. No.: 752,657

[22] Filed: Nov. 19, 1996

[51] Int. Cl.[6] ..... A47B 13/08

[52] U.S. Cl. ..... 108/90

[58] Field of Search ..... 108/90; 150/158

[56] References Cited

U.S. PATENT DOCUMENTS

| | | | |
|---|---|---|---|
| 1,219,790 | 3/1917 | Taylor | 108/90 |
| 1,240,208 | 9/1917 | Holtmeyer | 108/90 |
| 1,332,776 | 3/1920 | Sultanaki | 108/90 X |
| 3,279,515 | 10/1966 | Kesh | 108/90 |
| 3,368,601 | 2/1968 | Gantert-merz | 108/90 |
| 4,750,402 | 6/1988 | Markey | 108/90 X |
| 4,991,242 | 2/1991 | Brown | 108/90 X |
| 5,339,748 | 8/1994 | Bilotti | 108/90 |

*Primary Examiner*—Jose V. Chen
*Attorney, Agent, or Firm*—David L. Volk

[57] ABSTRACT

A table cover includes a top and a side when the table cover is spread upon a table. An elongated panel includes a plurality of hanging loops there-along, and is configured to fasten to the side of the table cover.

8 Claims, 7 Drawing Sheets

TABLE COVER SYSTEM

BACKGROUND OF THE INVENTION

1. Field of the Invention

The present invention relates to table covers.

2. Description of the Related Art

Table cloths or covers which can be maintained securely on a table, even in outdoor weather, are known in the prior art. Such table covers employ elastic near the edge. The table cover is placed over the table and the elastic edges are extended around and underneath the table edge. What is needed is a decorating system for these types of table covers, as well as for conventional table covers.

SUMMARY OF THE INVENTION

The table cover system of the present invention includes a table cover and an elongated panel. The table cover includes a top and a side when the table cover is spread upon a table. The elongated panel includes a plurality of hanging loops there-along, and is configured to fasten to the side of the table cover. Various articles may be hung from the loops for decorating the table cloth system, including but not limited to beads, ribbons and holiday ornaments. The table cover may include elastic along its edge for securing the table cover to a table top.

Accordingly, several objects and advantages of the present invention are:

a. to provide a table cover system which is decorative; and b. to provide a table cover system which can secure a table cloth to a table top, while simultaneously being pleasing to the eye.

Still further objects and advantages will become apparent from the ensuing description and drawings.

DETAILED DESCRIPTION

Figure 1:
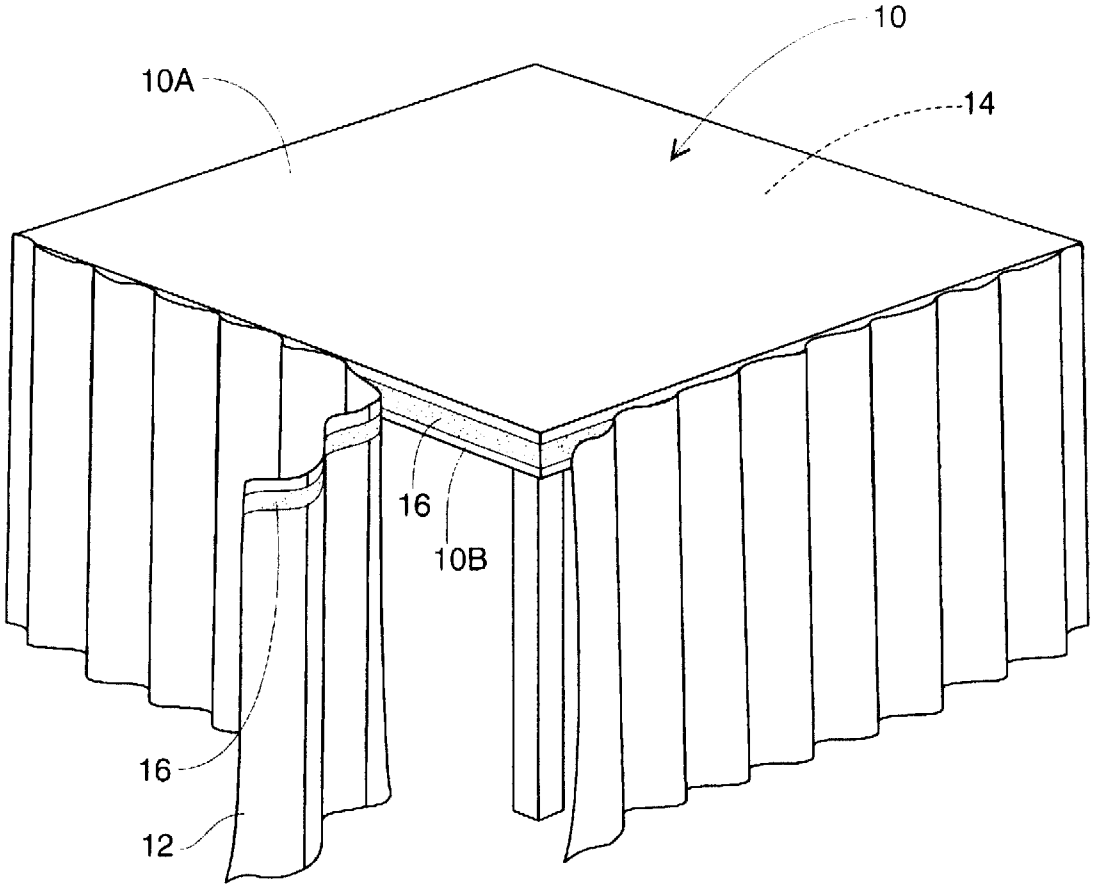
FIG. 1 is a perspective view of a fitted table cover and an elongated panel attachable thereto.

FIG. 1 is a perspective view of a fitted table cover 10 and an elongated panel 12 attachable thereto. The table cover 10 has a top 10A and a side 10B when the table cover 10 is spread upon a table top 14. The panel 12 is attachable to the side 10B by a hook and loop fastener 16, or by other fastening means including but not limited to buttons, snaps, and stitching.

Figure 2:
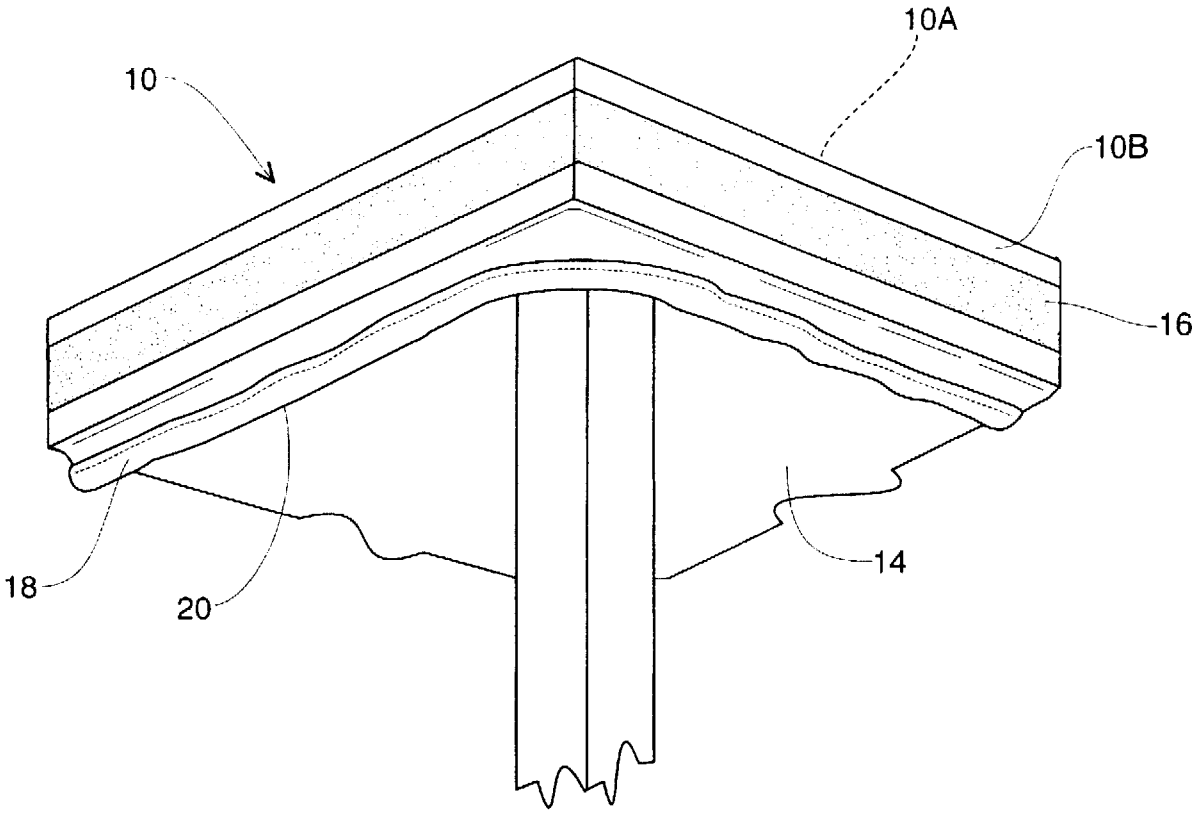
FIG. 2 is a partial perspective view from the underside of a table, showing elastic along an edge of the table cover.

FIG. 2 is a partial perspective view from the underside of the table top 14, showing elastic 18 along an edge 20 of the table cover 10. The elastic 18 helps to secure the table cover 10 on the table top 14.

Figure 2A:
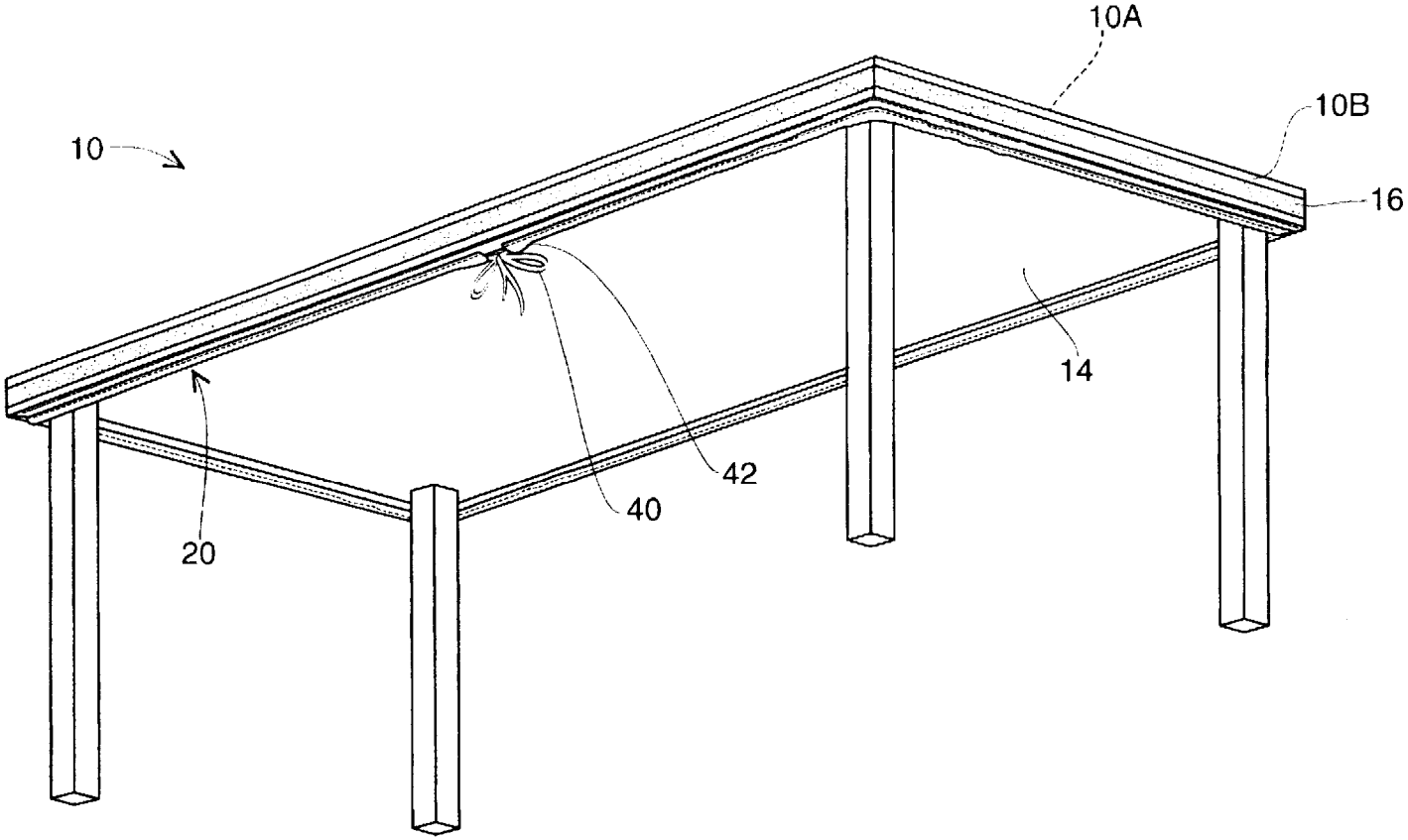
FIG. 2A is a perspective view from the underside of a table, showing a drawstring along the edge of the table

FIG. 2A is a partial perspective view from the underside of the table 14, showing a drawstring 40 disposed within a pocket 42 along the edge 20 of the table cover 10. Each end of the drawstring 40 extends outwardly from the pocket 42 and may be tied together to secure the table cover 10 on the table top 14.

Figure 3:
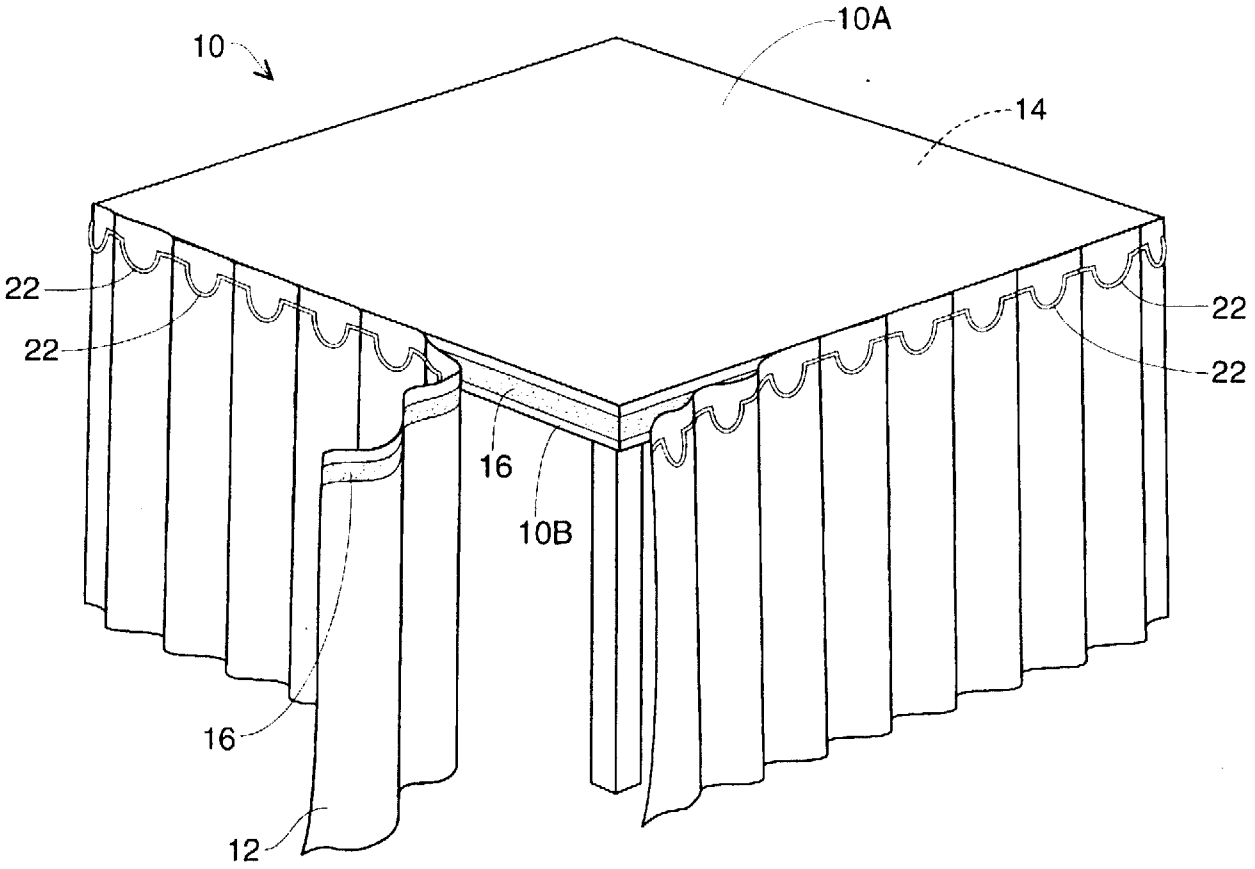
FIG. 3 is a perspective view of the table cover, similar to FIG. 1, further showing hanging loops attached to the panel.

FIG. 3 is a perspective view of the table cover 10 and the attachable panel 12. In this embodiment, a plurality of hanging loops 22 are attached to the panel 12, distributed along the panel 12 near a top edge 24 thereof. The hanging loops 22 may be fabricated from an elongated cloth member having straight portions stitched to the panel 12 and portions hanging from the panel 12 in a loop fashion, as shown. The loops 22 may also be formed from individual elongated members with no straight portions between the loops 22. The loops 22 may form cradle shapes as shown, or may be stitched to the panel 12 in a tear drop or other shape.

Figure 4:
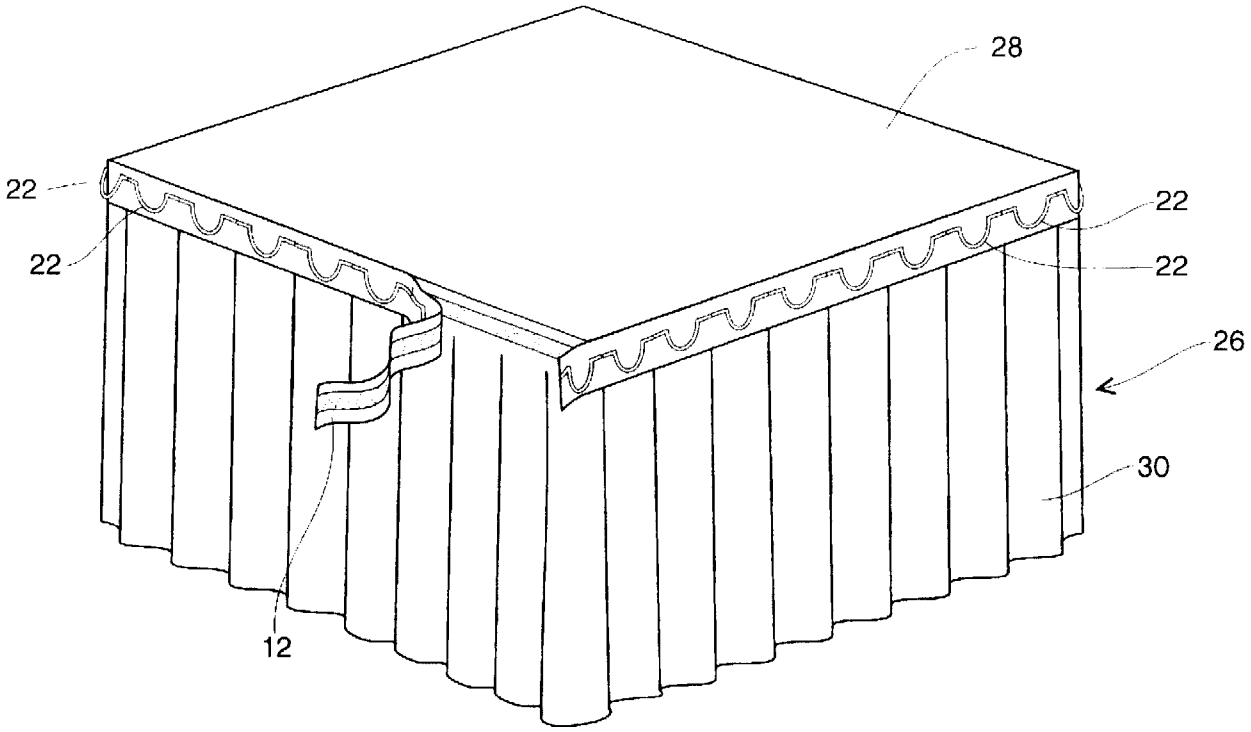
FIG. 4 is a perspective view of a table cover which forms a top surface and a skirt when draped upon a table, having an elongated panel attachable thereto.

FIG. 4 is a perspective view of a skirt-forming table cover 26 which forms a top surface 28 and a skirt 30 when draped upon a table, having the elongated panel 12 attachable thereto. In the previously described embodiments the panel 12 formed a skirt shape and the table cover 10 did not form a skirt shape. In the embodiment of FIG. 4, the skirt-forming table cover 26 forms the skirt 30, and the panel 12 is less wide and does not form a skirt shape.

Figure 4A:
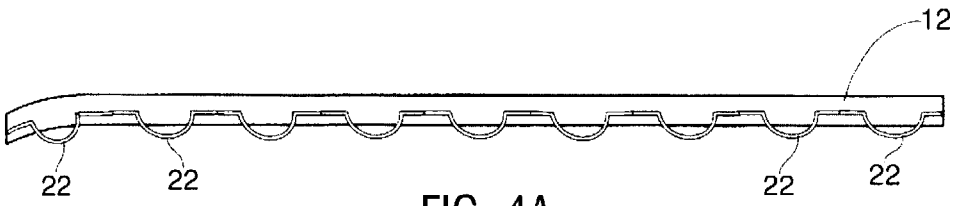
FIG. 4A is an elevational view of an alternate embodiment of the elongated panel, wherein the panel is substantially thin and portions of the loops hang below the panel.

FIG. 4A is an elevational view of an alternate embodiment of the elongated panel 12, wherein the panel 12 is less wide than in FIG. 4, and portions of the loops 22 hang below the panel 12.

Figure 5:
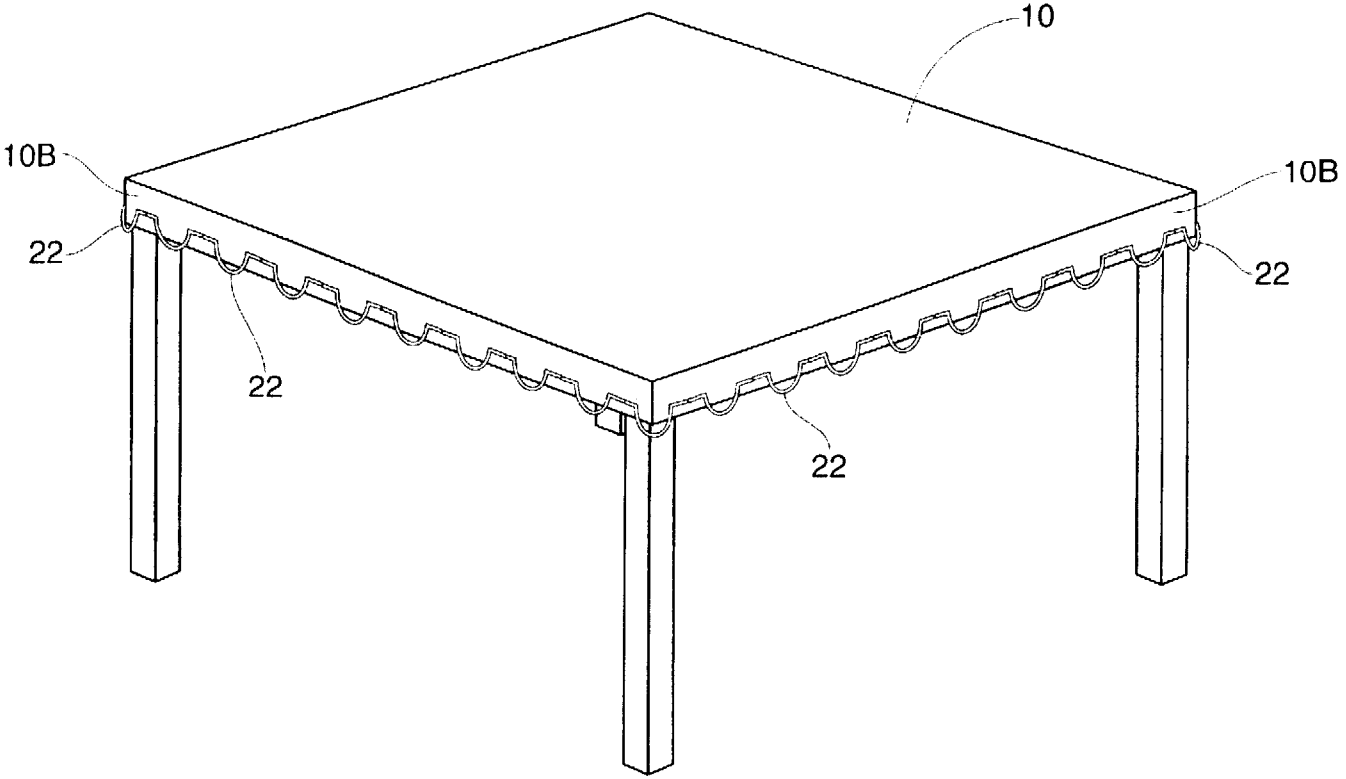
FIG. 5 is a perspective view of a fitted table cover having elastic on its edge, and hanging loops attached directly to the side thereof.

FIG. 5 is a perspective view of a fitted table cover 10 having elastic 18 on its edge 20, and hanging loops 22 attached directly to the side 10B thereof.

Figure 6:
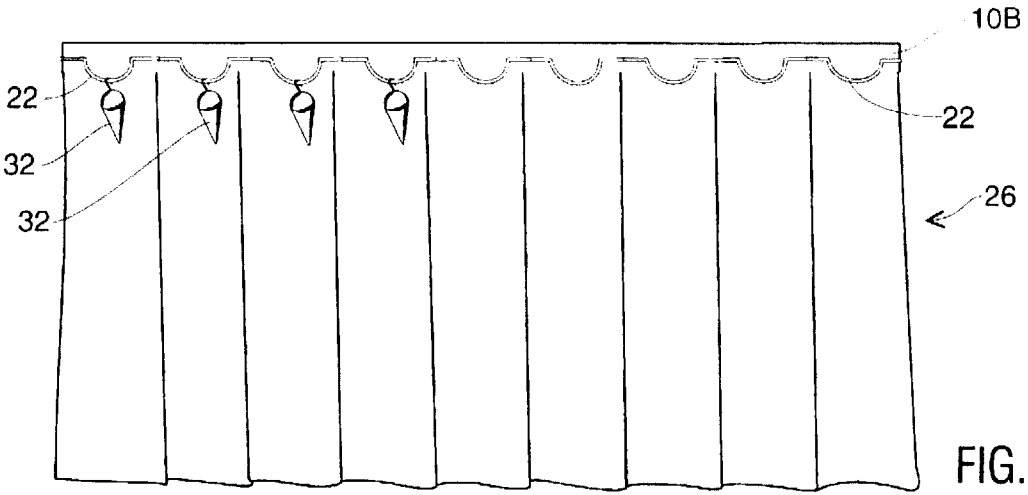
FIG. 6 is an elevational view of a table cover which forms a top surface and a skirt when draped on a table, having hanging loops attached directly to the skirt and ornamentation hanging from the loops

FIG. 6 is an elevational view of the skirt-forming table cover 26, having hanging loops 22 attached directly to the side 10B and ornamentation 32 hanging from the loops 22. The ornamentation 32 is not a part of the present invention, but may be hung from the loops 22 of the present invention.

Figure 7:
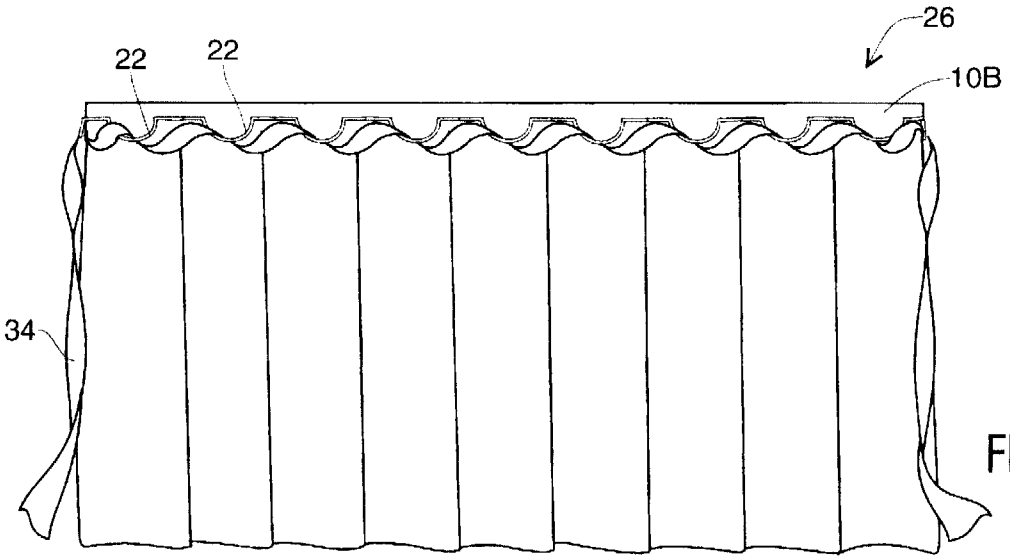
FIG. 7 is an elevational view of a table cover which forms a top surface and a skirt when draped on a table, having hanging loops attached directly to the skirt and a ribbon laced through the loops.

FIG. 7 is an elevational view of the skirt-forming table cover 26, having hanging loops 22 attached directly to the side 10B and a ribbon 34 laced through the loops 22. The ribbon 34 is not a part of the present invention, but may be laced through the loops 22 of the present invention.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. The scope of the invention is to be limited only by the following claims and their legal equivalents.

The invention claimed is:

1. A table cover system comprising:

a. a table cover having a top and a side when the table cover is spread upon a table;

b. an elongated panel having a first broad surface opposite a second broad surface;

c. fastening means for attaching the elongated panel to the table cover along the side such that the first broad surface faces the table cover; and d. a plurality of elongated, slender cloth segments each having a first end opposite a second end, the first and second ends of each segment connected to the second broad surface of the elongated panel and a center of each segment hanging limply free from and unattached to the panel, each segment forming a loop hanging limply against the second broad surface of the elongated panel, the segments distributed continuously along the elongated panel, the segments not being a part of the fastening means.

2. The table cover system of claim 1, wherein the table cover includes an edge and an elastic portion disposed along the edge.

3. The table cover system of claim 1, wherein the table cover includes an edge, a pocket disposed along the edge, and a drawstring disposed along and within the pocket.

4. A table cover comprising a top and a side when the table cover is spread upon a table, and a plurality of elongated, slender cloth segments each having a first end opposite a second end, the first and second ends of each segment connected to the side of the table cover, and a center of each segment hanging limply free from and unattached to the table cover, each segment forming a loop hanging limply against the side of the table cover, the segments distributed continuously along the side of the table cover.

5. The table cover system of claim 4, wherein the table cover includes an edge and an elastic portion disposed along the edge.

6. The table cover system of claim 4, wherein the table cover includes an edge, a pocket disposed along the edge, and a drawstring disposed along and within the pocket.

7. An elongated panel having a first broad surface opposite a second broad surface and a fastening means for attaching the elongated panel along a side of a table cover such that the first broad surface faces the table cover, the panel having a plurality of elongated, slender cloth segments each having a first end opposite a second end, the first and second ends of each segment connected to the second broad surface of the elongated panel, and a center of each segment hanging limply free from and unattached to the panel, each segment forming a loop hanging limply against the second broad surface of the elongated panel, the segments distributed continuously along the elongated panel, the segments not being a part of the fastening means.

8. The panel of claim 7, further including a fastening means for attaching the panel to a table cover.

* * * * *